US007264659B1

(12) United States Patent
Moshenrose

(10) Patent No.: US 7,264,659 B1
(45) Date of Patent: Sep. 4, 2007

(54) PLATE FASTENER FOR AN ELECTROSTATIC PRECIPITATOR CELL

(76) Inventor: Paul A. Moshenrose, 3108 Magnolia La., Ocean Springs, MS (US) 39564

( * ) Notice: Subject to any disclaimer, the term of this patent is extended or adjusted under 35 U.S.C. 154(b) by 0 days.

(21) Appl. No.: 11/431,313

(22) Filed: May 10, 2006

(51) Int. Cl.
*B03C 3/47* (2006.01)

(52) U.S. Cl. ..... 96/86; 96/87; 96/88

(58) Field of Classification Search ..... 96/79, 96/83–88; 248/544, 606; 411/373, 375
See application file for complete search history.

(56) References Cited

U.S. PATENT DOCUMENTS

| | | | | | |
|---|---|---|---|---|---|
| 2,470,356 | A * | 5/1949 | MacKenzie | 96/87 |
| 2,535,696 | A * | 12/1950 | Richardson | 96/86 |
| 2,714,939 | A * | 8/1955 | Richardson | 96/86 |
| 2,798,572 | A * | 7/1957 | Fields | 96/79 |
| 2,869,678 | A * | 1/1959 | Roberts | 96/79 |
| 3,006,066 | A * | 10/1961 | Grossen et al. | 29/421.1 |
| 3,114,616 | A * | 12/1963 | Palmore | 96/86 |
| 3,175,341 | A * | 3/1965 | Winter | 96/86 |
| 3,581,470 | A * | 6/1971 | Aitenhead et al. | 96/79 |
| 3,985,525 | A * | 10/1976 | Tomaides | 96/79 |
| 4,341,537 | A | 7/1982 | Rodgers | 323/903 X |
| 5,100,439 | A | 3/1992 | Kemp | 29/890.04 |
| 5,421,863 | A * | 6/1995 | Rector et al. | 96/60 |
| 5,433,772 | A * | 7/1995 | Sikora | 96/87 |
| 6,096,119 | A * | 8/2000 | Ho et al. | 96/79 |
| 6,852,149 | B2 * | 2/2005 | Huang | 96/79 |
| 6,958,089 | B1 * | 10/2005 | Huang | 96/79 |
| 2005/0045038 | A1 * | 3/2005 | Huang | 96/83 |
| 2006/0086250 | A1 * | 4/2006 | Moshenrose | 96/86 |

FOREIGN PATENT DOCUMENTS

| | | | | |
|---|---|---|---|---|
| JP | 4-322757 A * | 11/1992 | | 96/87 |

* cited by examiner

*Primary Examiner*—Richard L. Chiesa
(74) *Attorney, Agent, or Firm*—The Ollila Law Group LLC

(57) ABSTRACT

A plate fastener for an electrostatic precipitator cell is provided according to an embodiment of the invention. The plate fastener includes a fastener shaft including a head. The fastener shaft extends through the electrostatic precipitator cell. The head is adapted to retain a first end plate of the electrostatic precipitator cell. The plate fastener further includes a plurality of spacers configured to fit onto the fastener shaft. A spacer of the plurality of spacers is adapted to be positioned between successive polarity plates of a plurality of plates of the electrostatic precipitator cell. The plate fastener further includes a one-way shaft retainer configured to affix to the fastener shaft. The one-way shaft retainer is adapted to retain a second end plate of the electrostatic precipitator cell. The plate fastener affixes the plurality of plates together into a set of spaced-apart plates.

23 Claims, 8 Drawing Sheets

PLATE FASTENER FOR AN ELECTROSTATIC PRECIPITATOR CELL

TECHNICAL FIELD

The present invention relates to an electrostatic precipitator cell, and more particularly, to a plate fastener for an electrostatic precipitator cell.

BACKGROUND OF THE INVENTION

Air cleaners and purifiers are widely used for removing foreign substances from air. The foreign substances can include pollen, dander, smoke, pollutants, dust, etc. In addition, an air cleaner can be used to circulate room air. An air cleaner can be used in many settings, including at home, in offices, etc.

One type of air cleaner is an electrostatic precipitator. An electrostatic precipitator operates by creating an electrical field. Dirt and debris in the air becomes ionized when it is brought into the electrical field by an airflow. Charged positive and negative electrodes in the electrostatic precipitator air cleaner, such as positive and negative plates or positive and grounded plates, create the electrical field and one of the electrode polarities attracts the ionized dirt and debris. Periodically, the electrostatic precipitator can be removed and cleaned. Because the electrostatic precipitator comprises electrodes or plates through which airflow can easily and quickly pass, only a low amount of energy is required to provide airflow through the electrostatic precipitator. As a result, foreign objects in the air can be efficiently and effectively removed without the need for a mechanical filter element.

In the prior art, a typical electrostatic precipitator cell is mass produced. The prior art electrostatic precipitator cell includes multiple plates and is typically formed out of stamped sheet metal. The plates are commonly welded or crimped together to form some manner of fixed structure. Alternatively, the plates are assembled into some manner of end frame portions that include a plurality of slots or grooves that receive and trap the ends of the plates. As a result, the prior art electrostatic precipitator cell is specially designed for a particular implementation, including the number of plates, the plate spacing and voltage requirements, the overall physical size and shape, etc.

The prior art has several drawbacks. The prior art electrostatic element is formed of permanently attached components in a fixed spacing. The assembled size and/or tolerance of a prior art electrostatic precipitator therefore cannot be adjusted or controlled. A prior art welding or crimping manufacturing method results in an electrostatic precipitator cell that cannot be tailored to various applications. In addition, the welding operation can cause warping of electrode plates. The prior art electrostatic precipitator cell cannot be constructed with varying numbers of plates. The prior art electrostatic precipitator cell cannot be assembled for a custom or specialized application.

SUMMARY OF THE INVENTION

A plate fastener for an electrostatic precipitator cell is provided according to an embodiment of the invention. The plate fastener comprises a fastener shaft including a head. The fastener shaft extends through the electrostatic precipitator cell. The head is adapted to retain a first end plate of the electrostatic precipitator cell. The plate fastener further comprises a plurality of spacers configured to fit onto the fastener shaft. A spacer is adapted to be positioned between successive polarity plates of a plurality of plates of the electrostatic precipitator cell. The plate fastener further comprises a one-way shaft retainer configured to affix to the fastener shaft. The one-way shaft retainer is adapted to retain a second end plate of the electrostatic precipitator cell. The plate fastener affixes the plurality of plates together into a set of spaced-apart plates.

A collection plate fastener for an electrostatic precipitator cell is provided according to an embodiment of the invention. The collection plate fastener comprises a fastener shaft including a head. The fastener shaft extends through the electrostatic precipitator cell. The head is adapted to contact a first end collection plate of the electrostatic precipitator cell. The collection plate fastener further comprises a plurality of collection plate spacers configured to fit onto the fastener shaft. A collection plate spacer is adapted to be positioned between two adjacent collection plates of a plurality of collection plates of the electrostatic precipitator cell. The collection plate fastener further comprises a one-way shaft retainer configured to affix to the fastener shaft. The one-way shaft retainer is adapted to contact a second end collection plate of the electrostatic precipitator cell. The collection plate fastener affixes the plurality of collection plates together into a set of spaced-apart collection plates.

A charge plate fastener for an electrostatic precipitator cell is provided according to an embodiment of the invention. The charge plate fastener comprises a first end cap adapted to contact a first end collection plate of the electrostatic precipitator cell and a second end cap adapted to contact a second end collection plate of the electrostatic precipitator cell. The first and second end caps are formed of an electrical insulator material. The charge plate fastener further comprises a fastener shaft including a head. The fastener shaft extends through the electrostatic precipitator cell and the head fits to the first end cap. The charge plate fastener further comprises a plurality of charge plate spacers configured to fit onto the fastener shaft. A charge plate spacer is positioned between two adjacent charge plates of a plurality of charge plates of the electrostatic precipitator cell. The charge plate fastener further comprises a one-way shaft retainer configured to affix to the fastener shaft. The one-way shaft retainer fits to the second end cap. The charge plate fastener affixes the plurality of charge plates together into a set of spaced-apart charge plates.

An electrostatic precipitator cell is provided according to an embodiment of the invention. The electrostatic precipitator cell comprises two or more collection plates arranged in a substantially parallel fashion and including first and second collection plates and one or more charge plates arranged in a substantially parallel fashion and interleaved between the two or more collection plates. The electrostatic precipitator cell further comprises one or more collection plate fasteners extending through the electrostatic precipitator cell between the first and second end collection plates. A collection plate fastener comprises a collection plate fastener shaft including a head. The collection plate fastener shaft extends through the electrostatic precipitator cell. The head is adapted to contact the first end collection plate of the electrostatic precipitator cell. The collection plate fastener further comprises a plurality of collection plate spacers configured to fit onto the collection plate fastener shaft. A collection plate spacer of the plurality of collection plate spacers is adapted to be positioned between two adjacent collection plates of a plurality of collection plates of the electrostatic precipitator cell. The collection plate fastener further comprises a one-way shaft retainer configured to affix to the collection plate fastener shaft. The one-way shaft retainer is adapted to contact the second end collection plate of the electrostatic precipitator cell. The collection plate fastener affixes the plurality of collection plates together into a set of spaced-apart collection plates. The electrostatic precipitator cell further comprises one or more charge plate fasteners extending through the electrostatic precipitator cell between the first and second end collection plates. A charge plate fastener comprises a first end cap adapted to contact the first end collection plate of the electrostatic precipitator cell and a second end cap adapted to contact the second end collection plate. The first and second end caps are formed of an electrical insulator material. The charge plate fastener further comprises a charge plate fastener shaft including a head. The charge plate fastener shaft extends through the electrostatic precipitator cell and the head fits to the first end cap. The charge plate fastener further comprises a plurality of charge plate spacers configured to fit onto the charge plate fastener shaft. A charge plate spacer of the plurality of charge plate spacers is positioned between two adjacent charge plates of a plurality of charge plates of the electrostatic precipitator cell. The charge plate fastener further comprises a one-way shaft retainer configured to affix to the charge plate fastener shaft. The one-way shaft retainer fits to the second end cap. The charge plate fastener affixes the plurality of charge plates together into a set of spaced-apart charge plates.

BRIEF DESCRIPTION OF THE DRAWINGS

The same reference number represents the same element on all drawings. It should be noted that the drawings are not necessarily to scale.

DETAILED DESCRIPTION OF THE INVENTION

FIGS. 1-8 and the following descriptions depict specific embodiments to teach those skilled in the art how to make and use the best mode of the invention. For the purpose of teaching inventive principles, some conventional aspects have been simplified or omitted. Those skilled in the art will appreciate variations from these embodiments that fall within the scope of the invention. Those skilled in the art will also appreciate that the features described below can be combined in various ways to form multiple variations of the invention. As a result, the invention is not limited to the specific embodiments described below, but only by the claims and their equivalents.

Figure 1:
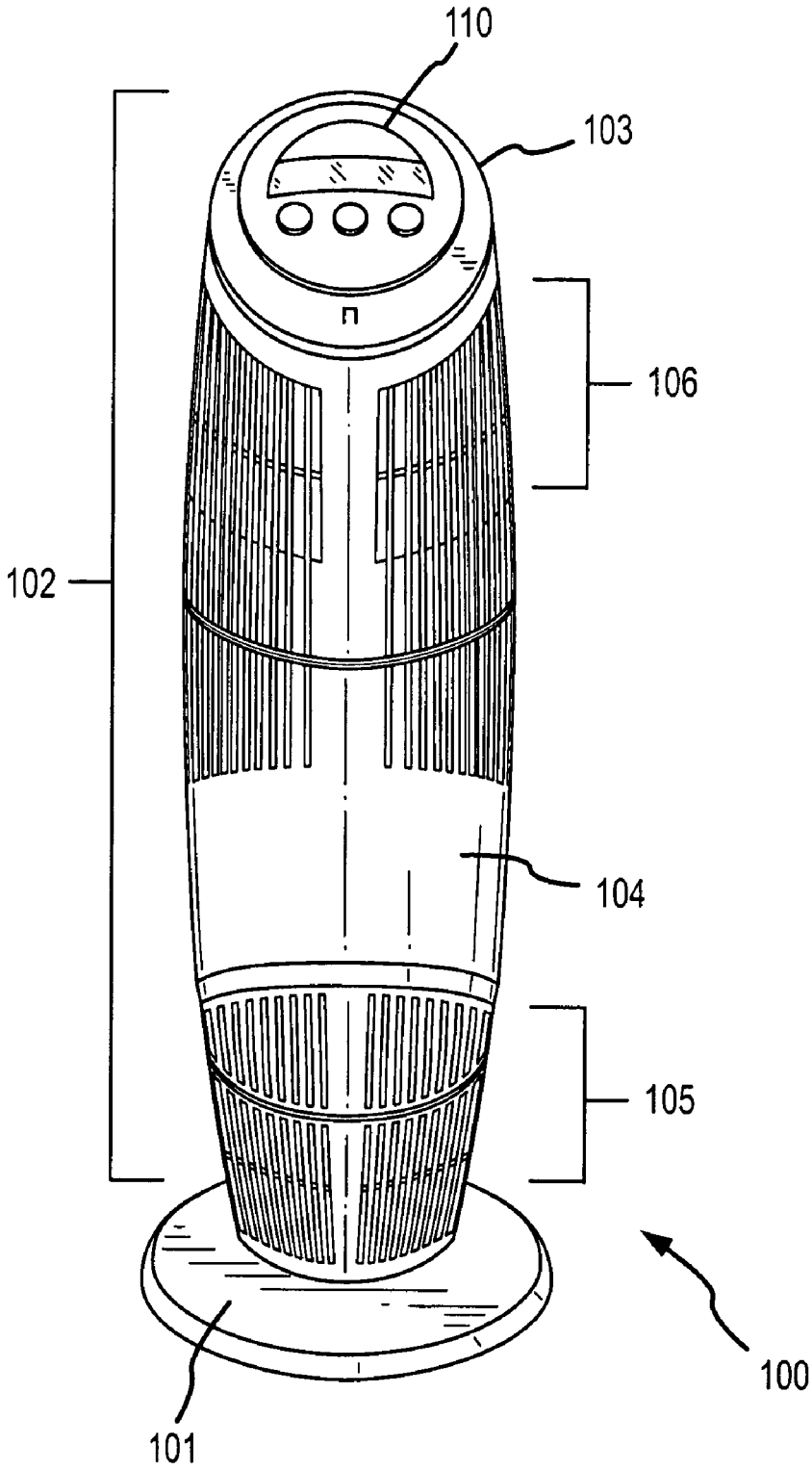
FIG. 1 shows a tower air cleaner according to an embodiment of the invention.

FIG. 1 shows a tower air cleaner 100 according to an embodiment of the invention. The air cleaner 100 includes a base portion 101 and a tower portion 102. The tower portion 102 can be generally vertically positioned and elongate in shape. In one embodiment, the tower portion 102 can be substantially cylindrical in shape. The tower portion 102 includes a shell 103, one or more doors 104, and a control panel 110. The tower portion 102 further includes an air inlet 105 and an air outlet 106. Air is drawn in through the air inlet 105, is cleaned inside the tower portion 102, and the cleaned air is exhausted from the air outlet 106.

The air inlet 105 is shown as being at the lower end of the tower portion 102. However, it should be understood that alternatively the relative positions of the air inlet 105 and the air outlet 106 could be interchanged.

Figure 2:
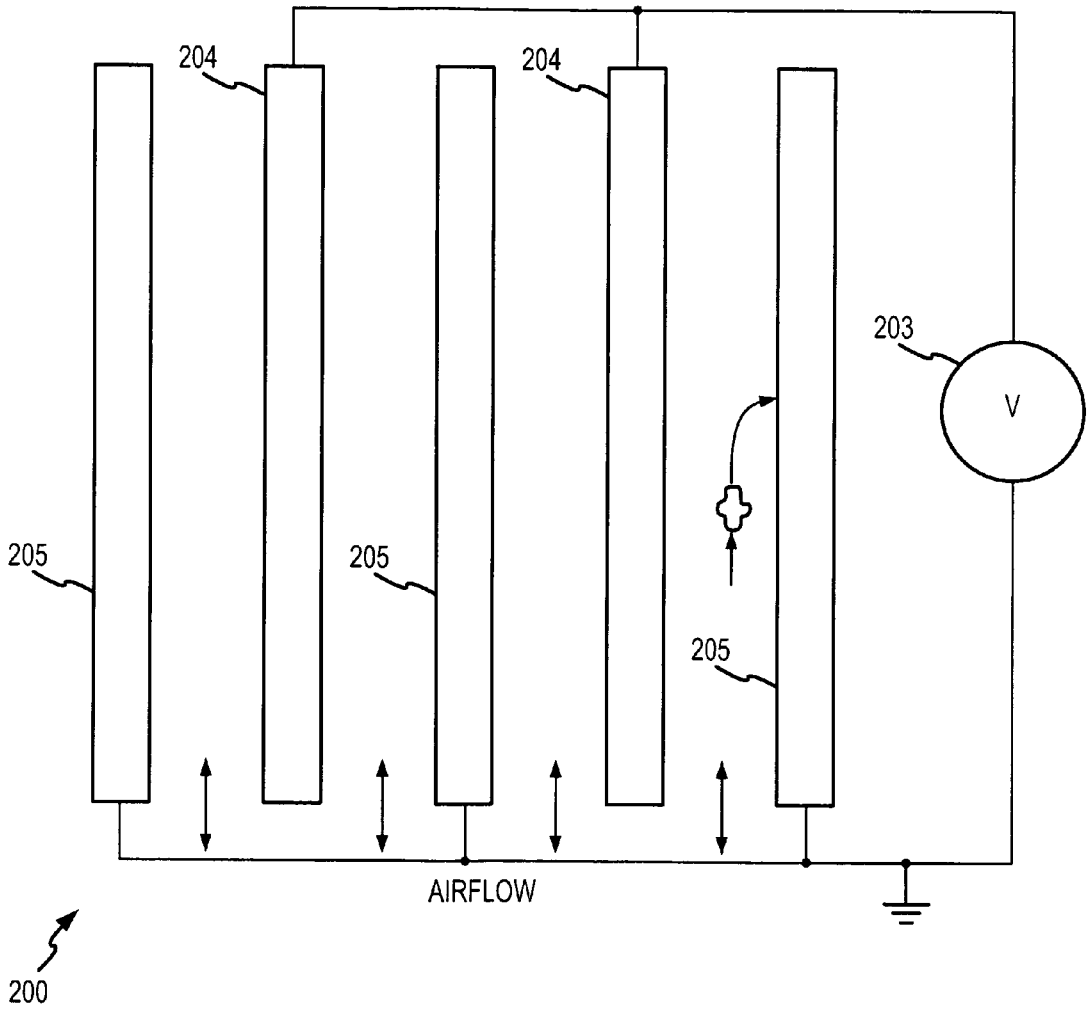
FIG. 2 shows an electrostatic precipitator cell according to an embodiment of the invention.

FIG. 2 shows an electrostatic precipitator cell 200 according to an embodiment of the invention. The electrostatic precipitator cell 200 includes one or more charge plates 204, one or more collection plates 205, and a voltage source 203. The charge plates 204 and the collection plates 205 can be formed of any manner of electrically conductive material, such as sheet metal, for example. In addition, the charge plates 204 and the collection plates 205 can be formed of any thickness.

In operation, a voltage potential is placed between adjacent plates of the one or more charge plates 204 and the one or more collection plates 205, creating one or more electrical fields. In one embodiment, a positive voltage potential is placed on the one or more charge plates 204 and a ground (or negative) voltage potential is placed on the one or more collection plates 205. However, it should be understood that the voltage field can be reversed. As a result, there is a voltage potential between the one or more charge plates 204 and the one or more collection plates 302. Therefore, air traveling through the electrostatic precipitator cell 200 (such as from bottom to top or top to bottom) is ionized by the voltage potential as the airflow passes through the electrostatic precipitator cell 200 and between the plates 204 and 205. As a consequence, dirt and debris entrained in the airflow is charged (typically a positive charge) and the charged dirt and debris is attracted to the one or more collection plates 205. The airflow, now without the dirt and debris, passes through the electrostatic precipitator cell 200 and is exhausted from the electrostatic precipitator cell 200 in a substantially cleaned condition.

The charge plates 204 and the collection plates 205 can be spaced-apart and can be substantially parallel. The precipitator plates can be a series of any number of plates positioned at any desired spacing. The electrostatic precipitator cell 200 therefore can be of any desired size and of any desired plate density.

Figure 3:
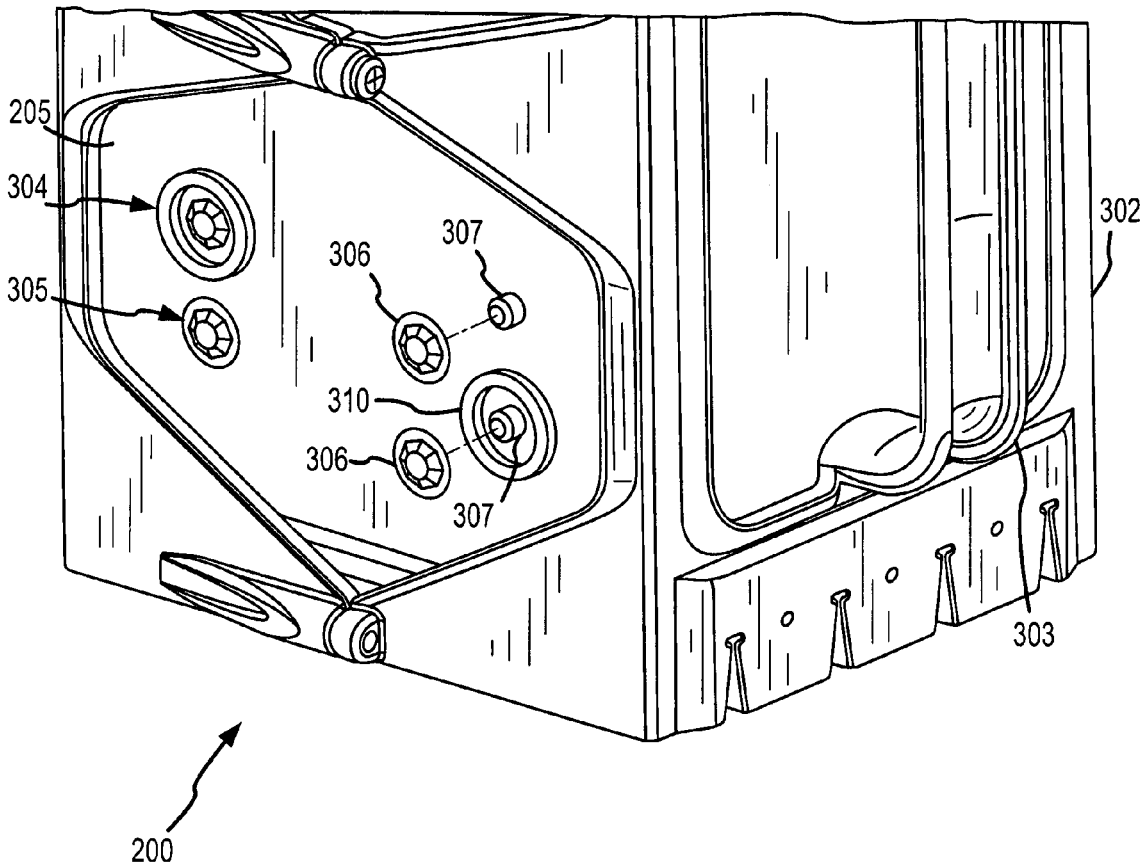
FIG. 3 shows the electrostatic precipitator cell according to an embodiment of the invention.

FIG. 3 shows the electrostatic precipitator cell 200 according to an embodiment of the invention. The electrostatic precipitator cell 200 includes a top opening 320 (see FIG. 5), a bottom opening 330, a frame 302 that can include a handle 303, a series of charge plates 204 and collection plates 205 (see FIG. 4), charge plate fasteners 304, and collection plate fasteners 305. The components, when assembled as shown, form the electrostatic precipitator cell 200 for precipitating foreign matter out of an airflow.

A one-way shaft retainer 306 can be pressed or otherwise assembled onto the fastener shaft 307. It should be noted that a fastener shaft 307 can include a chamfered end in order to aid in placing the one-way shaft retainer 306 on the fastener shaft 307. The one-way shaft retainer 306 can include one or more angled jaws that permit the one-way shaft retainer 306 to slide substantially freely on a fastener shaft 307 in only one direction. In an opposite direction, the one or more jaws grip the fastener shaft 307 and substantially prevent movement. The one-way shaft retainer 306 can engage the fastener shaft 307 through some manner of friction fit, spring engagement, etc. The one-way shaft retainer 306 engages the fastener shaft 307 substantially only in one direction. The one-way shaft retainer 306 can use any manner of springs, clips, spring teeth, etc.

An advantage of the one-way shaft retainer 306 is that it will slide relatively easily in one direction during installation. However, a significant amount of force is required to remove the one-way shaft retainer 306 in the opposite direction. As a result, the one-way shaft retainer 306 can be easily assembled onto the fastener shaft 307, but generally cannot be removed without tools. In addition, the one-way shaft retainer 306 will not move or loosen in the presence of vibration. Moreover, the one-way shaft retainer 306 can typically be re-installed after removal, enabling dis-assembly and repair of the electrostatic precipitator cell 200 and subsequent re-assembly.

In one embodiment, the one-way shaft retainer 306 comprises a spring clip that is formed out of a resilient material and that includes offset, angled portions that operate to prevent the one-way shaft retainer 306 from being easily removed from the fastener shaft 307. In one embodiment, the one-way shaft retainer 306 comprises a Tinnerman clip.

The figure also shows an end cap 310 that is part of the charge plate fastener 304. The end cap 310 is formed of an electrical insulator material and insulates the fastener shaft 307 from the end collection plate 205. The one-way shaft retainer 306 in one embodiment seats into the end cap 310. It should be noted that the collection plate fasteners 305 do not require any end cap, and only a one-way shaft retainer 306 is used to affix the fastener shaft 307 to the end collection plate 205.

Figure 4:
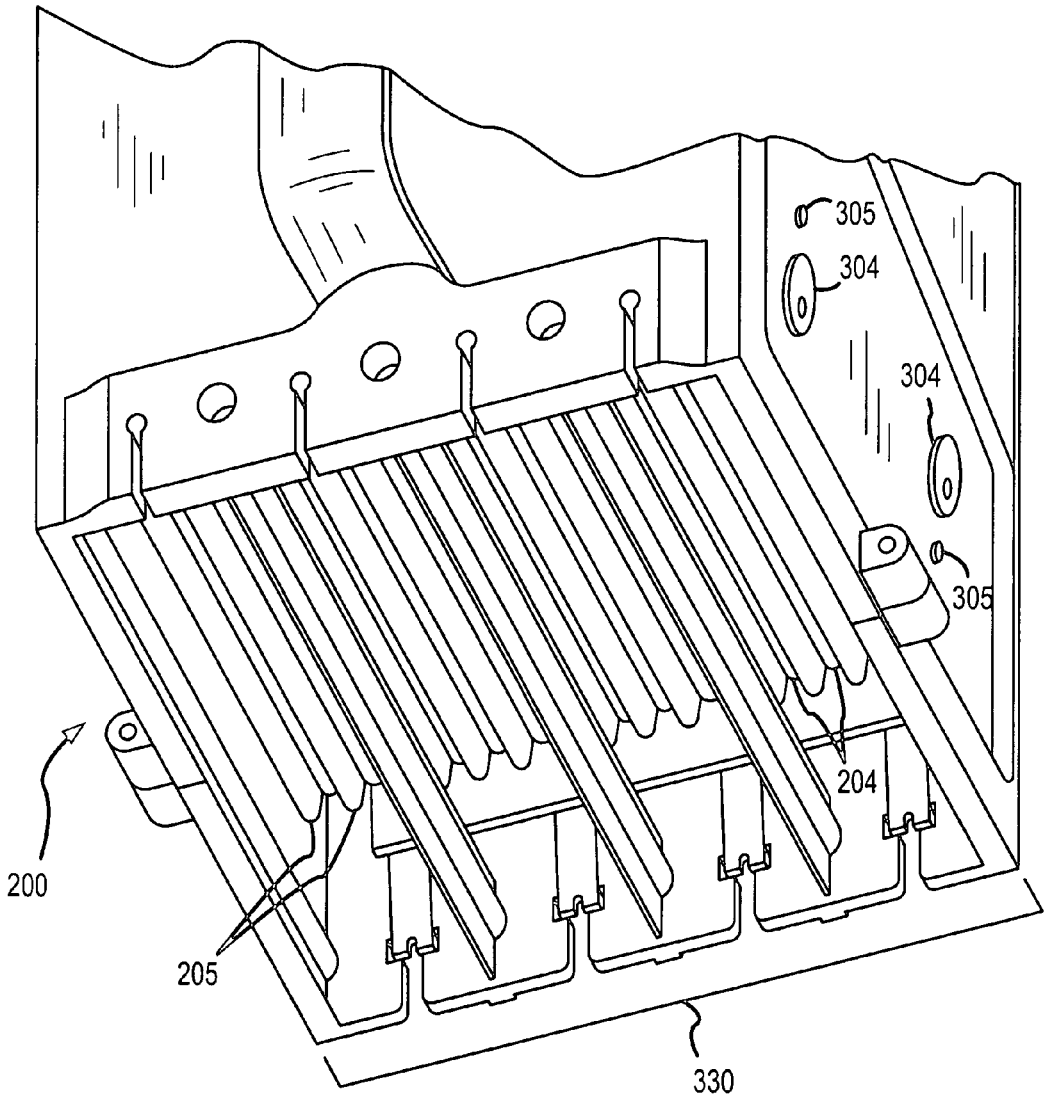
FIG. 4 is a bottom view of the electrostatic precipitator cell looking up into a bottom opening.

FIG. 4 is a bottom view of the electrostatic precipitator cell 200 looking up into the bottom opening 330. This figure shows alternating charge plates 204 and collection plates 205, among other things.

Figure 5:
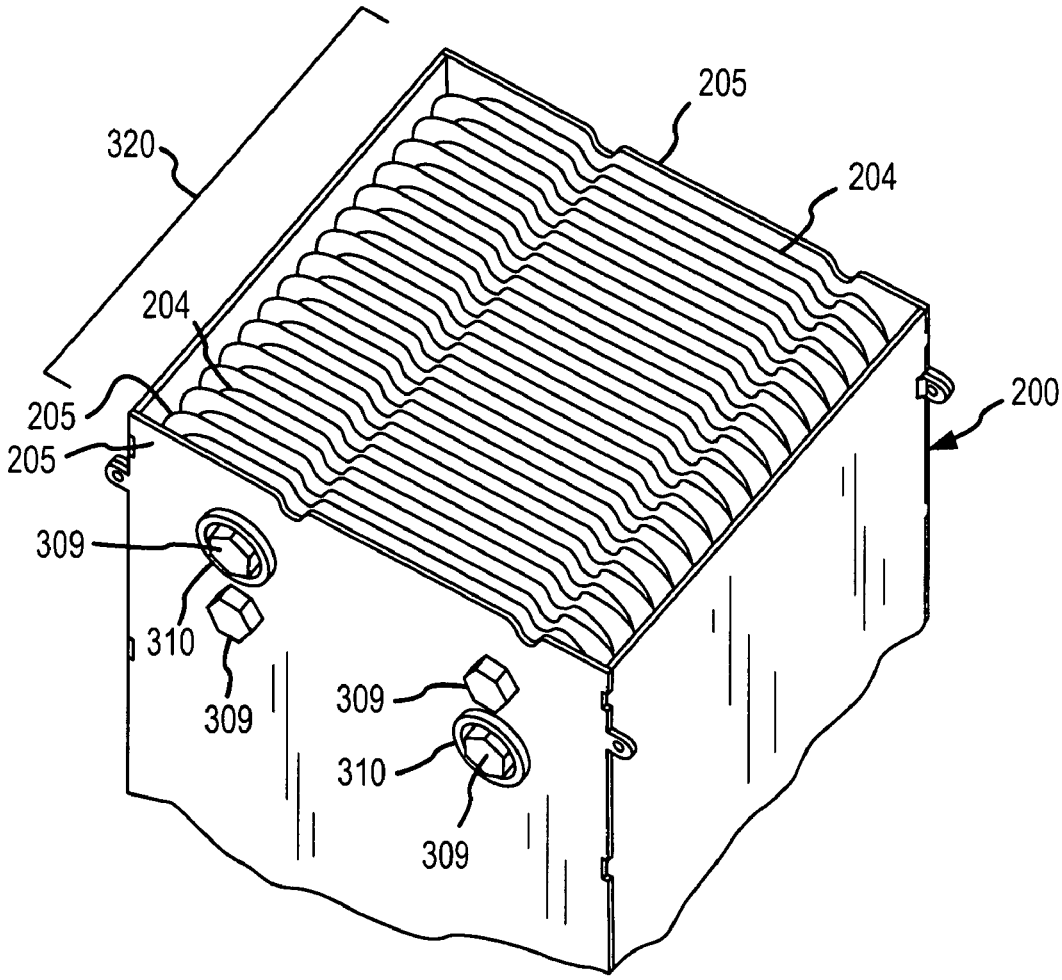
FIG. 5 shows an opposite side of the electrostatic precipitator cell from the side shown in FIG. 3.

FIG. 5 shows an opposite side of the electrostatic precipitator cell 200 from the side shown in FIG. 3. At this side of the electrostatic precipitator cell 200, the opposite end of a fastener shaft 307 is shown. The opposite end of the fastener shaft 307 can include some manner of head 309 (also see FIGS. 6-7).

Figure 6:
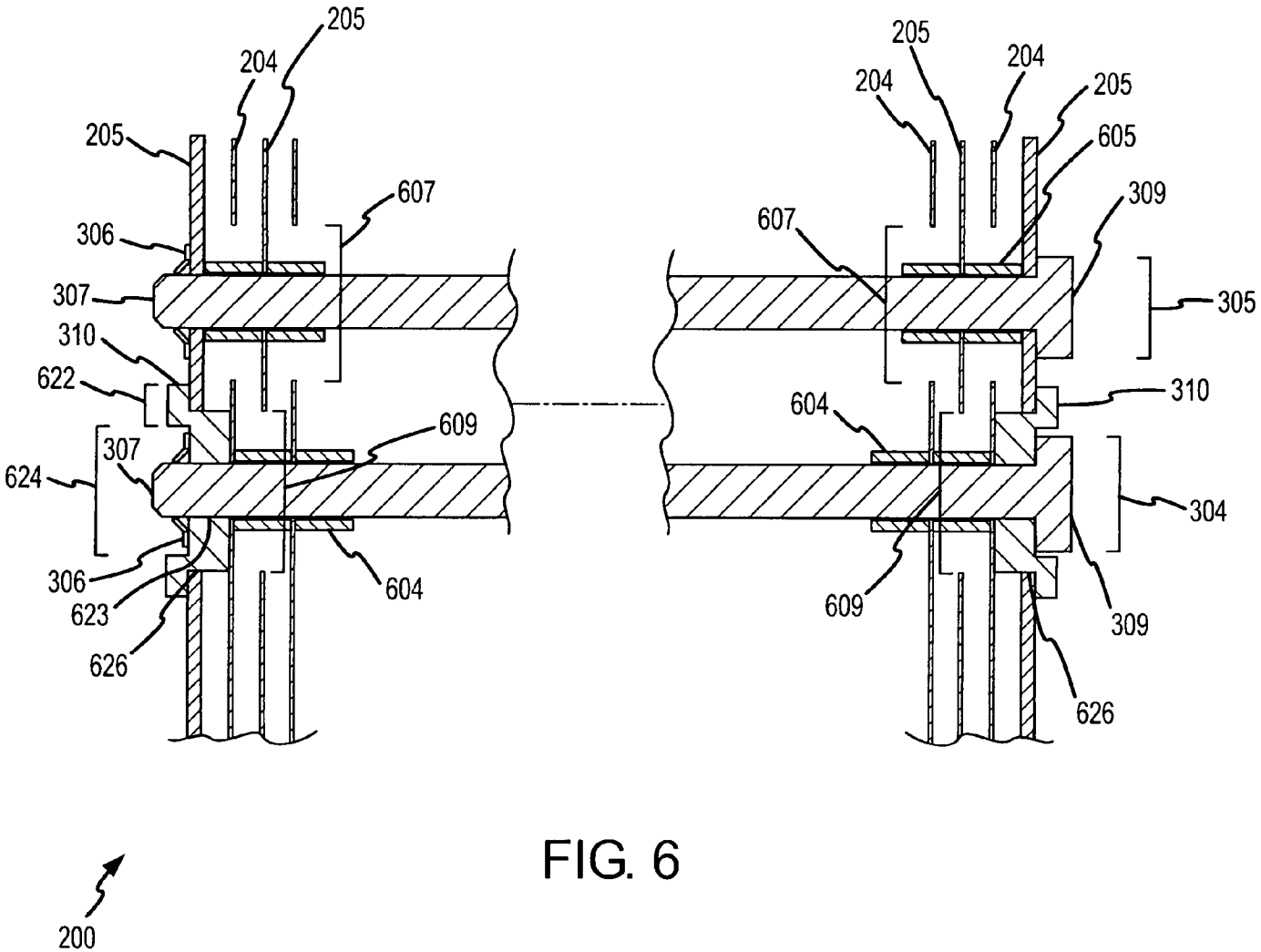
FIG. 6 shows a portion of the electrostatic precipitator cell and the charge plate fasteners and collection plate fasteners according to an embodiment of the invention.

FIG. 6 shows a portion of the electrostatic precipitator cell 200 and the charge plate fasteners 304 and collection plate fasteners 305 according to an embodiment of the invention. This figure shows the charge plates 204, the collection plates 205, and the fastener systems 304 and 305 that hold the plates in position in order to form the electrostatic precipitator cell 200. The collection plate fasteners 305 and the charge plate fasteners 304 are employed to fasten together (or removably fasten together) multiple plates of a common polarity (such as a collection polarity and a charge polarity), in order to form the electrostatic precipitator cell 200. The electrostatic precipitator cell 200 can include multiple sets of collection plate fasteners 305 and charge plate fasteners 304 in various configurations.

The collection plate fastener 305 in this embodiment fastens the plurality of collection plates 205 together into a set of spaced-apart plates in fixed positions. The collection plate fastener 305 includes the fastener shaft 307 including a head 309, the one-way shaft retainer 306, and a plurality of collection plate spacers 605. The collection plate spacers 605 fit over the fastener shaft 307 and space apart the collection plates 205, wherein each collection plate spacer 605 contacts two adjacent collection plates 205. Therefore, each collection plate spacer 605 is positioned between successive polarity plates of the electrostatic precipitator cell 200 (i.e., between successive collection plates 205). Consequently, the fastener shaft 307 of the collection plate fastener 305 is at the same voltage potential as the collection plates 205. Where the collection plates 205 are at a ground voltage potential, the two end collection plates 205 are also at a ground voltage potential. In addition, the charge plates 204 each include a charge plate clearance aperture 607 that is larger than the collection plate spacers 605, wherein the charge plate clearance apertures 607 of the charge plates 204 are aligned and allow the collection plate fastener 305 to pass through all of the charge plates 204 without touching. In one embodiment, the charge plate clearance apertures 607 are of a size and clearance from the collection plate spacers 605 in order to prevent arcing between the two components. When assembled, the head 309 of the fastener shaft 307 contacts the outer surface of one end collection plate 205 and the one-way shaft retainer 306 contacts the outer surface of the opposite end collection plate 205.

The charge plate fastener 304 in this embodiment fastens the plurality of charge plates 204 together into a set of spaced-apart plates in fixed positions. The charge plate fastener 304 includes the fastener shaft 307 and head 309, the one-way shaft retainer 306, two end caps 310, and a plurality of charge plate spacers 604. The charge plate spacers 604 fit over the fastener shaft 307 and space apart the charge plates 204, wherein each charge plate spacer 604 contacts two adjacent charge plates 204. Therefore, each charge plate spacer 604 is positioned between successive polarity plates of the electrostatic precipitator cell 200 (i.e., between successive charge plates 204). Consequently, the fastener shaft 307 of the charge plate fastener 304 is at the same voltage potential as the charge plates 204. In addition, the collection plates 205 each include a collection plate clearance aperture 609 that is larger than the charge plate spacers 604, wherein the collection plate clearance apertures 609 in the collection plates 205 are aligned and allow the charge plate fastener 304 to pass through all of the collection plates 205 without touching. In one embodiment, the collection plate clearance apertures 609 are of a size and clearance from the charge plate spacers 604 in order to prevent arcing between the two components. When assembled, the head 309 of the fastener shaft 307 fits into one end cap 310 which contacts the outer surface of one end collection plate 205 and the one-way shaft retainer 306 seats within another end cap 310 which contacts the outer surface of the opposite end collection plate 205.

The end cap 310 is formed of an electrical insulator material. The end cap 310 in one embodiment includes a flange 622 and a shaft aperture 623, and can further include a fastener depression 624. The end caps 310 fit into outer apertures 626 in the two end collection plates 205 of the electrostatic precipitator cell 200. The end caps 310 in one embodiment are pressed into the outer apertures 626 in a press fit. When an end cap 310 is assembled to an outer aperture 626 of the end collection plate 205, the flange 622 contacts an outer surface of the end collection plate 205.

The fastener shaft 307 can comprise a substantially smooth cylinder or bar, as shown. The fastener shaft 307 can comprise any cross-sectional shape, including a circular cross-sectional shape (shown). The fastener shaft 307 can cooperate with the one-way shaft retainer 306. Alternatively, the fastener shaft 307 can comprise a threaded fastener, such as a threaded bolt and nut, some manner of rivet, some manner of snap fastener, etc., that can attach and retain the plates 204 and 205. In one embodiment, the fastener shaft 307 can be substantially solid (shown). Alternatively, in another embodiment the fastener shaft 307 can be partially or substantially hollow, such as a tube. The fastener shaft 307 can comprise an electrical conductor or insulator material.

The collection plate spacers 605 and the charge plate spacers 604 fit between adjacent charge plates 204 and collection plates 205, and therefore set and control the distances between the plates. The spacers 604 and 606 in one embodiment comprise cylindrical sections having a length, an inner diameter, and an outer diameter. However, it should be understood that the spacers 604 and 606 do not necessarily have to be cylindrical in shape.

The spacers 604 and 606 in one embodiment are formed of an electrical insulator material. Alternatively, the spacers 604 and 606 can be formed of an electrical conductor material.

Figure 7:
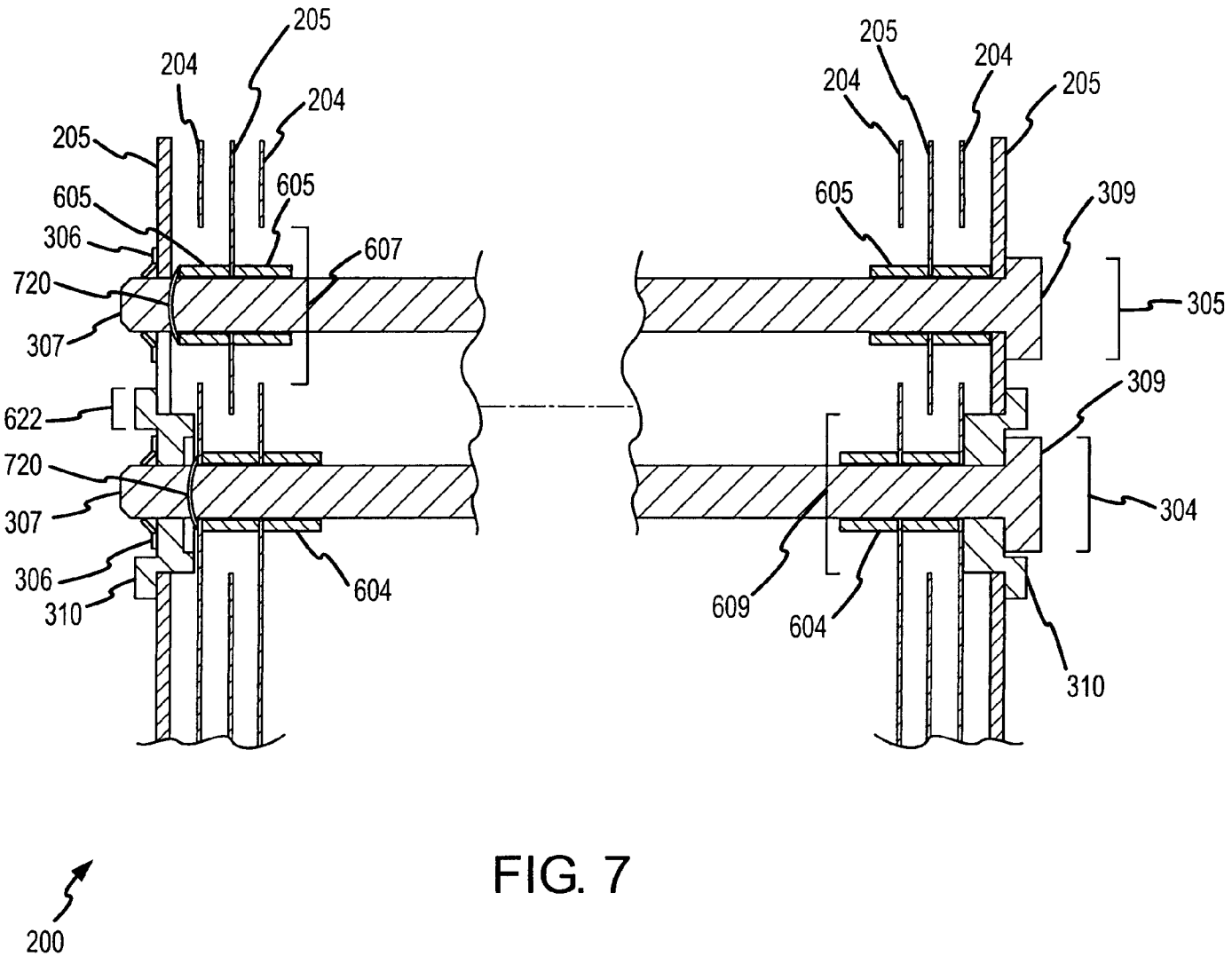
FIG. 7 shows a portion of the electrostatic precipitator cell and the charge plate fasteners and collection plate fasteners according to another embodiment of the invention.

FIG. 7 shows a portion of the electrostatic precipitator cell 200 and the charge plate fasteners 304 and collection plate fasteners 305 according to another embodiment of the invention. Elements in common with FIG. 6 share reference numbers. As in the previous figure, this figure shows the charge plates 204, the collection plates 205, and the fastener systems 304 and 305 that hold the plates in position in order to form the electrostatic precipitator cell 200. In addition to the previously recited components, in this embodiment one or both of the fasteners 304 and 305 can each include at least one deformable spacer 720.

The deformable spacer 720 is positioned between an outermost charge plate spacer 304 or collection plate spacer 605 and the end collection plate 205. The deformable spacer 720 enables an inward compression force on the electrostatic precipitator cell 200 to be varied by the application and/or placement of the corresponding one-way shaft retainer 306 in order to achieve a desired cell size or tolerance.

One difficulty in forming an electrostatic precipitator cell is in achieving an acceptable overall dimension or tolerance. The individual spacers 604 and 605 and the plates 204 and 205 can exhibit various tolerances. Problematically, tolerance variations in the spacers 604 and 605 and in the plates 204 and 205 are additive. Consequently, the assembled electrostatic precipitator cells produced by a manufacturing process will exhibit variations in overall dimensions. The fasteners 304 and 305 in this embodiment enable the assembled cell size to be adjusted and can accommodate various irregularities and dimensional variations in the components. Therefore, during assembly of the electrostatic precipitator cell 200, the deformable spacer(s) 720 can be compressed as needed in order to achieve the desired size or tolerance. If the assembled cell size is too large, the collection plate and charge plate fasteners 304 and 305 can be further adjusted, compressing the deformable spacers 720 and thereby decreasing the assembled cell size.

It should be understood that the deformable spacer 720 can be compressed until the entire deformable spacer 720 is substantially planar. The amount of compression distance yielded by the deformable spacer 720 can depend on the amount of offset width W of the deformable spacer 720 (see FIGS. 8A-8D). If the assembled cell tolerance is within a maximum desired size of the electrostatic precipitator cell 200, the deformable spacer 720 may not need to be compressed.

It should be understood that the fasteners 304 and/or 305 can include just one deformable spacer 720, as shown. Alternatively, they can include two deformable spacers 720, such as one at each end of the fastener shaft 307. The fastener can even include multiple deformable spacers 720 in a single end cap 310, wherein the multiple spacers 720 achieve a desired thickness and/or achieve a desired range of compression.

Figure 8A:
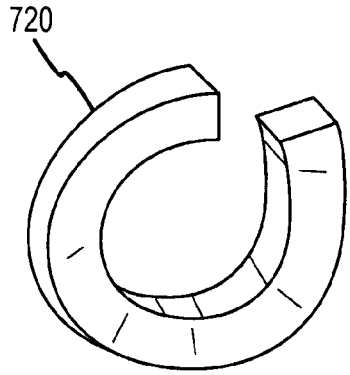
FIGS. 8A-8D show a deformable spacer according to various embodiments of the invention.
Figure 8B:
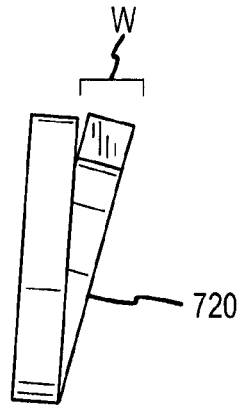

FIGS. 8A-8D show the deformable spacer 720 according to various embodiments of the invention. FIGS. 8A and 8B show a deformable spacer 720 according to one embodiment of the invention. The deformable spacer 720 in the embodiment shown comprises a wave washer (or lock washer). The deformable spacer in this embodiment comprises a metal ring that is split and has a substantially helical curl. The deformable spacer 720 in this embodiment is formed of a resilient material, and can be substantially flattened if it is compressed under a compression force. The deformable spacer 720 in some embodiments can be compressed by the full amount of the offset width W. The deformable spacer 720 can be used to provide a compression-resisting force as part of the electrostatic precipitator cell 200.

Figure 8C:
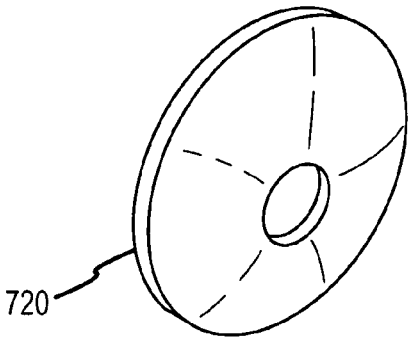
Figure 8D:
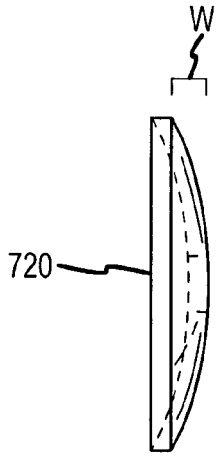

FIGS. 8C and 8D show the deformable spacer 720 according to another embodiment of the invention. The deformable spacer 720 in this embodiment comprises a bowed disc that is formed from a resilient material, such as spring steel, for example. The deformable spacer 720 in this embodiment can be substantially flattened if it is compressed under a compression force. As was previously discussed, the deformable spacer 720 in some embodiments can be compressed by the full amount of the offset width W.

The electrostatic precipitator cell according the invention can be implemented according to any of the embodiments in order to obtain several advantages, if desired. The electrostatic precipitator cell can be easily and efficiently manufactured, including manufacturing custom applications or specialized applications. The electrostatic precipitator cell can be assembled with any number of charge plates and collection plates, and therefore can be easily and conveniently assembled for a particular application. The one-way shaft retainer according to the invention can enable a varying number of plates to be included in an electrostatic precipitator cell. The electrostatic precipitator cell can be assembled using charge plate fasteners and collection plate fasteners according to the invention. The electrostatic precipitator cell can be assembled with all of the plates being substantially parallel. The electrostatic precipitator cell can be assembled wherein the spacing between adjacent plates is set by spacers. The electrostatic precipitator cell can be assembled wherein the spacing between adjacent plates is substantially uniform. The electrostatic precipitator cell can be assembled wherein the spacing between adjacent plates is set by spacers and wherein the assembled cell size can be adjusted and compensated for by the fasteners. The invention can provide an effective and efficient electrostatic precipitator type air cleaner device.

What is claimed is:

1. A plate fastener for an electrostatic precipitator cell, the collection plate fastener comprising:

a fastener shaft including a head, with the fastener shaft extending through the electrostatic precipitator cell and with the head being adapted to retain a first end plate of the electrostatic precipitator cell;

a plurality of spacers configured to fit onto the fastener shaft, with a spacer of the plurality of spacers being adapted to be positioned between successive polarity plates of a plurality of plates of the electrostatic precipitator cell; and a one-way shaft retainer configured to affix to the fastener shaft, with the one-way shaft retainer being adapted to retain a second end plate of the electrostatic precipitator cell, wherein the plate fastener affixes the plurality of plates together into a set of spaced-apart plates.

2. The plate fastener of claim 1, with the one-way shaft retainer being configured to removably affix to the fastener shaft.

3. The plate fastener of claim 1, further comprising a deformable spacer adapted to be positioned between an end plate and an adjacent spacer.

4. The plate fastener of claim 1, further comprising a deformable spacer adapted to be positioned between an end plate and an adjacent spacer, with the deformable spacer comprising a wave washer.

5. The plate fastener of claim 1, further comprising a deformable spacer adapted to be positioned between an end plate and an adjacent spacer, with the deformable spacer comprising a bowed disc.

6. The plate fastener of claim 1, with the plate fastener comprising a collection plate fastener.

7. The plate fastener of claim 1, with the plate fastener comprising a charge plate fastener.

8. The plate fastener of claim 1, with the plate fastener comprising a charge plate fastener, and with the charge plate fastener further comprising:

a first end cap adapted to contact a first end plate of the electrostatic precipitator cell and configured to receive the head of the fastener shaft; and a second end cap adapted to contact a second end plate of the electrostatic precipitator cell and configured to receive the one-way shaft retainer, with the first and second end caps being formed of an electrical insulator material.

9. A collection plate fastener for an electrostatic precipitator cell, the collection plate fastener comprising:

a fastener shaft including a head, with the fastener shaft extending through the electrostatic precipitator cell and with the head being adapted to contact a first end collection plate of the electrostatic precipitator cell;

a plurality of collection plate spacers configured to fit onto the fastener shaft, with a collection plate spacer of the plurality of collection plate spacers being adapted to be positioned between two adjacent collection plates of a plurality of collection plates of the electrostatic precipitator cell; and a one-way shaft retainer configured to affix to the fastener shaft, with the one-way shaft retainer being adapted to contact a second end collection plate of the electrostatic precipitator cell, wherein the collection plate fastener affixes the plurality of collection plates together into a set of spaced-apart collection plates.

10. The collection plate fastener of claim 9, with the one-way shaft retainer being configured to removably affix to the fastener shaft.

11. The collection plate fastener of claim 9, further comprising a deformable spacer adapted to be positioned between an end collection plate and an adjacent spacer.

12. The collection plate fastener of claim 9, further comprising a deformable spacer adapted to be positioned between an end collection plate and an adjacent spacer, with the deformable spacer comprising a wave washer.

13. The collection plate fastener of claim 9, further comprising a deformable spacer adapted to be positioned between an end collection plate and an adjacent spacer, with the deformable spacer comprising a bowed disc.

14. A charge plate fastener for an electrostatic precipitator cell, the charge plate fastener comprising:

a first end cap adapted to contact a first end collection plate of the electrostatic precipitator cell;

a second end cap adapted to contact a second end collection plate of the electrostatic precipitator cell, with the first and second end caps being formed of an electrical insulator material;

a fastener shaft including a head, with the fastener shaft extending through the electrostatic precipitator cell and with the head fitting to the first end cap;

a plurality of charge plate spacers configured to fit onto the fastener shaft, with a charge plate spacer of the plurality of charge plate spacers being positioned between two adjacent charge plates of a plurality of charge plates of the electrostatic precipitator cell; and a one-way shaft retainer configured to affix to the fastener shaft, with the one-way shaft retainer fitting to the second end cap, wherein the charge plate fastener affixes the plurality of charge plates together into a set of spaced-apart charge plates.

15. The charge plate fastener of claim 14, with the one-way shaft retainer being configured to removably affix to the fastener shaft.

16. The charge plate fastener of claim 14, further comprising a deformable spacer adapted to be positioned between an end collection plate and an adjacent spacer.

17. The charge plate fastener of claim 14, further comprising a deformable spacer adapted to be positioned between an end collection plate and an adjacent spacer, with the deformable spacer comprising a wave washer.

18. The charge plate fastener of claim 14, further comprising a deformable spacer adapted to be positioned between an end collection plate and an adjacent spacer, with the deformable spacer comprising a bowed disc.

19. An electrostatic precipitator cell, comprising:

two or more collection plates arranged in a substantially parallel fashion and including first and second end collection plates;

one or more charge plates arranged in a substantially parallel fashion and interleaved between the two or more collection plates;

one or more collection plate fasteners extending through the electrostatic precipitator cell between the first and second end collection plates, with a collection plate fastener of the one or more collection plate fasteners comprising:

a collection plate fastener shaft including a head, with the collection plate fastener shaft extending through the electrostatic precipitator cell and with the head being adapted to contact the first end collection plate of the electrostatic precipitator cell;

a plurality of collection plate spacers configured to fit onto the collection plate fastener shaft, with a collection plate spacer of the plurality of collection plate spacers being adapted to be positioned between two adjacent collection plates of a plurality of collection plates of the electrostatic precipitator cell; and a one-way shaft retainer configured to affix to the collection plate fastener shaft, with the one-way shaft retainer being adapted to contact the second end collection plate of the electrostatic precipitator cell, wherein the collection plate fastener affixes the plurality of collection plates together into a set of spaced-apart collection plates; and one or more charge plate fasteners extending through the electrostatic precipitator cell between the first and second end collection plates, with a charge plate fastener of the one or more charge plate fasteners comprising:

a first end cap adapted to contact a first end collection plate of the electrostatic precipitator cell;

a second end cap adapted to contact the second end collection plate, with the first and second end caps being formed of an electrical insulator material;

a charge plate fastener shaft including a head, with the charge plate fastener shaft extending through the electrostatic precipitator cell and with the head fitting to the first end cap;

a plurality of charge plate spacers configured to fit onto the charge plate fastener shaft, with a charge plate spacer of the plurality of charge plate spacers being positioned between two adjacent charge plates of a plurality of charge plates of the electrostatic precipitator cell; and a one-way shaft retainer configured to affix to the charge plate fastener shaft, with the one-way shaft retainer fitting to the second end cap, wherein the charge plate fastener affixes the plurality of charge plates together into a set of spaced-apart charge plates.

20. The electrostatic precipitator cell of claim 19, with the one-way shaft retainer being configured to removably affix to the fastener shaft.

21. The electrostatic precipitator cell of claim 19, further comprising a deformable spacer adapted to be positioned between an end collection plate and an adjacent spacer.

22. The electrostatic precipitator cell of claim 19, further comprising a deformable spacer adapted to be positioned between an end collection plate and an adjacent spacer, with the deformable spacer comprising a wave washer.

23. The electrostatic precipitator cell of claim 19, further comprising a deformable spacer adapted to be positioned between an end collection plate and an adjacent spacer, with the deformable spacer comprising a bowed disc.

* * * * *